US006097822A

United States Patent [19]

Min

[11] Patent Number: 6,097,822

[45] Date of Patent: Aug. 1, 2000

[54] VEST GARMENT FOR ACOUSTIC STIMULATION OF FETUS

[75] Inventor: David Min, Munster, Ind.

[73] Assignee: David Min, M.D., Inc., Munster, Ind.

[21] Appl. No.: 09/258,541

[22] Filed: Feb. 26, 1999

Related U.S. Application Data

[60] Provisional application No. 60/076,279, Feb. 27, 1998.

[51] Int. Cl.[7] ..... H04R 5/02

[52] U.S. Cl. ..... 381/301; 381/333; 381/388; 2/102

[58] Field of Search ..... 381/300, 301, 381/87, 333, 91, 122, 388; 2/48, 94, 95, 108, 102, 462

[56] References Cited

U.S. PATENT DOCUMENTS 4,539,700 9/1985 Sato ..... 381/301

5,109,421 4/1992 Fox ..... 381/301

5,699,558 12/1997 Min ..... 2/48

*Primary Examiner*—Minsun Oh Harvey

*Attorney, Agent, or Firm*—Banner & Witcoff

[57] ABSTRACT

A vest garment is provided for audio stimulation of a fetus by a birth mother includes a back and a left and a right bodice. The left and right bodice are stitched to the back along the sides and over the shoulders so that arms may be passed through an armhole opening defined by the back and each bodice. One bodice includes an audio speaker pocket strategically positioned over the stomach. The other bodice includes an audio signal source pocket which need not be strategically positioned, but which is arranged so as to counterbalance the weight of the speakers in the speaker pocket. An optional microphone input to the audio source signal pocket is provided as are supplemental headphones for the mother.

13 Claims, 1 Drawing Sheet

VEST GARMENT FOR ACOUSTIC STIMULATION OF FETUS

RELATED APPLICATION

This application is a continuation of provisional application Ser. No. 60/076,279, filed on Feb. 27, 1998 and entitled "VEST GARMENT FOR AUDIO STIMULATION OF FETUS."

BACKGROUND OF THE INVENTION

In a principal aspect, the present invention relates to a vest garment which may be used by pregnant women wherein the garment is fabricated to include an audio system which positions speakers against the fetal cavity or womb to thereby provide music or other audio stimulation for the fetus.

In U.S. Pat. No. 5,699,558, the present applicant discusses a particular garment for audio stimulation of a fetus. That patent is incorporated here by reference in its entirety. That patent discloses a particular apron configuration which may be used in conjunction with audio equipment for fetal stimulation. Nonetheless, there exists a need for other types of garments which can be used for such stimulation purposes. The present invention is directed to another particularized garment.

SUMMARY OF THE INVENTION

Briefly, the present invention comprises a garment in the form of a vest which includes pockets for speakers as well as an audio signal source. The garment may be easily used by a pregnant individual to strategically position the speakers adjacent the womb, yet further includes an arrangement of pockets for the equipment which enables the weight or load of the audio equipment to be evenly and effectively distributed. Thus, the invention comprises a garment capable of use by a birth mother and which includes a means for supporting and positioning, in an appropriate and proper manner, audio equipment, including audio speakers and an audio signal source. Apparatus such as tape players, radio receivers and the like are thus combined and held in position appropriately by means of a garment over the fetal cavity. A microphone system as well as an earphone system may be incorporated in combination with the garment and the audio equipment.

Thus, it is an object of the invention to provide an improved article of clothing which may be utilized to facilitate audio stimulation of a fetus in the fetal cavity or womb.

A further object is to provide a garment, and more particularly, a vest, which may be utilized to effectively and safely provide audio stimulation, including the sounds of a mother's voice to the fetus in the womb.

Another object of the invention is to provide an audio stimulation device wherein the mother may listen through earphones to that which is being played or provided as an audio stimulus to the fetus.

These and other objects, advantages and features of the invention will be set forth in a detailed description which follows.

BRIEF DESCRIPTION OF THE DRAWING

In the detailed description of FIG. 1 which follows, reference will be made to the drawing comprised of a single FIGURE illustrating in plan view the garment and audio stimulation device incorporated with the garment of the invention.

DESCRIPTION OF THE PREFERRED EMBODIMENT

Figure 1:
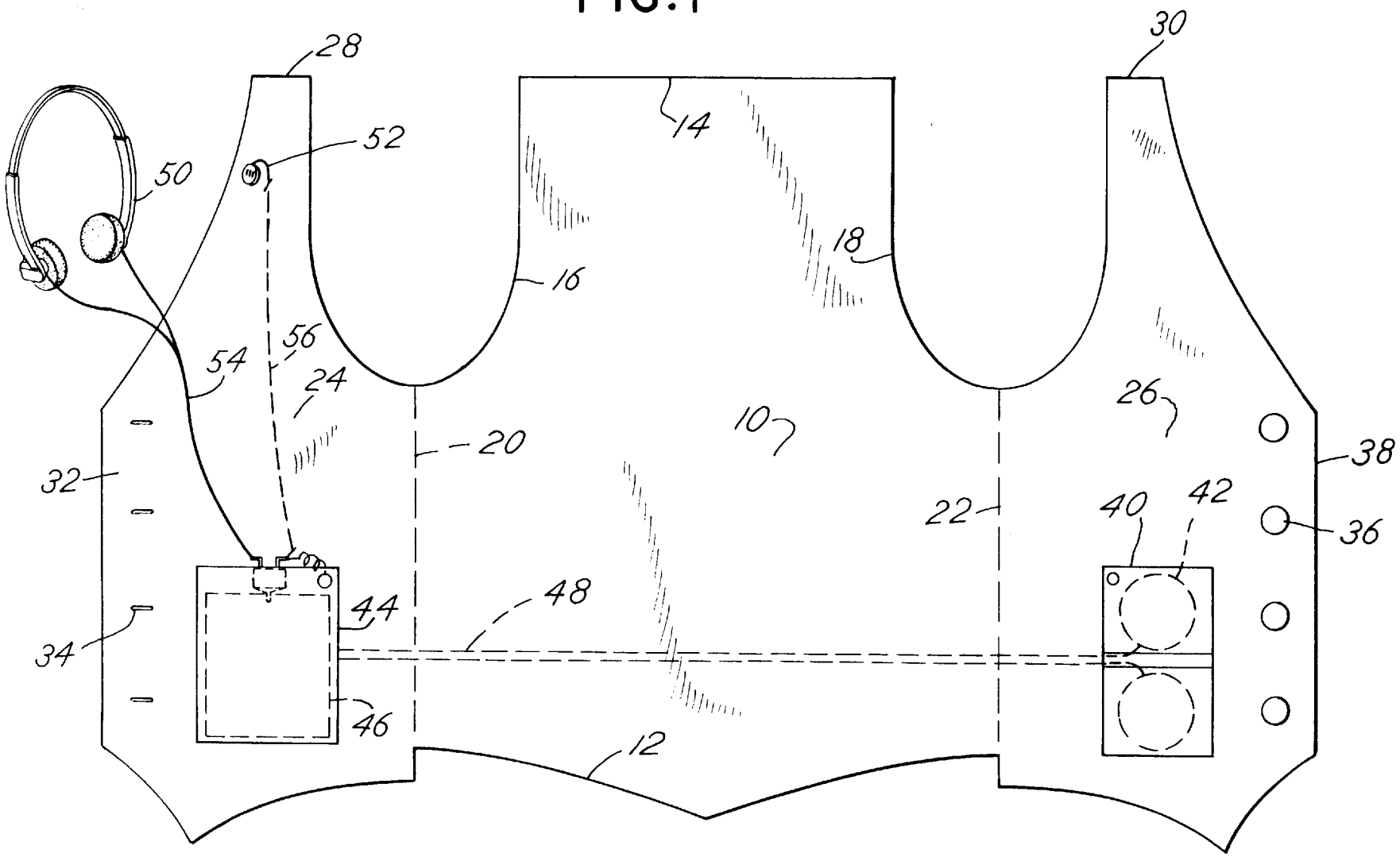

Referring to the FIGURE, the vest garment of the invention comprises a cloth back 10 which has a bottom or lower edge 12, a top or upper edge 14, side scallops 16 and 18, and sides 20 and 22. Attached to or integrally formed with the back 10 is a left bodice 24 and a right vest bodice 26. The bodice 24 is attached to, sewn to or combined with the back 10 at the side edge 20 of the back 10. Similarly, the right hand vest bodice 26 is attached, combined with or integrated with the back 10 along the side 22 of back 10. The left bodice includes an upper shoulder end 28 which fastens to the top 14 of the back 10 to define an armhole. In a similar fashion, an upper end 30 of bodice 26 connects to the upper side 14 of back 10 to define another armhole. The free or open side 32 of bodice 24 includes button holes 34 which receive buttons 36 associated with side edge 38 of bodice 26 so that the vest may be fastened in a fixed manner on the user. Of course, the positioning of the button must be preferably adjustable so that the user; namely, a pregnant woman can adjust the manner in which the vest is attached to accommodate the growth of the fetus. Such adjustment may be accomplished by using Velcro hook and eye mechanisms, buttons which are adjustable or other mechanisms which permit such adjustment.

The right hand bodice 26 in the embodiment shown includes a pocket 40 into which speakers 42 may be positioned. Importantly, the pocket 40 is strategically positioned so as to position the speakers in opposed relation to the fetus to provide the most efficient audio stimulation thereof. The left hand bodice 24 further includes a pocket 44 which receives audio reception or playing equipment such as a player 46. The player 46 connects with the speakers 42 to lines 48 which extend across the back 10 so as not to interfere with the utilization of the vest when it is buttoned or closed. Optional headphones 50 may connect to the audio player 46. Additionally, a lapel microphone 52 may be attached to the vest, and more particularly, to bodice 24 in appropriate juxta position to the mouth of the user to provide audio input through the player 46 to the speakers 42 by the mother. The headphones 50 as well as the microphone 52 are appropriately connected by lead wires 54 and 56 to the audio device 46.

It is possible to vary the construction the vest of the invention. As mentioned above, the fastening mechanism associated with the open sides of the vest may be varied in order to accommodate the condition of the birth mother. The pockets, such as pockets 40 and 44, may be adjustable but importantly are designed to be positioned so as to provide balanced counterweight on the vest to promote the comfort of the user. The configuration and shape of the vest may be altered or amended so as to accommodate the size of the individual using the garment. Thus, when all has been set forth the preferred embodiment of the invention, it is understood that the invention should be limited only by the following claim and equivalents thereof.

What is claimed is:

1. A garment for providing audio stimulation to a fetus comprising in combination:

a vest having a back, a left vest front bodice and a right vest front bodice, said left and right bodice defining in combination the front of the vest garment and connectable together at a generally vertical medial line, said left and right bodice each being permanently combined with the back, one bodice including an audio speaker pocket over a stomach portion of the vest, the other of said bodices including an audio signal source pocket for retaining a player, radio or the like as an audio stimulation source, and further including a transmission connection conduit from one bodice to the other of said bodices across the back whereby the vest may be worn with the bodices connected or unconnected while an audio speaker is activated.

2. The garment according to claim 1, further comprising an audio speaker, wherein said audio speaker pocket and said audio signal source pocket are arranged to provide balanced counterweight on said vest when said vest is worn.

3. The garment according to claim 1, further comprising means for positioning said audio speaker.

4. The garment according to claim 1, further comprising an audio speaker and a microphone system.

5. The garment according to claim 4, further comprising an audio signal source and an earphone system.

6. The garment according to claim 1, further comprising adjustable buttons wherein a pregnant woman can adjust the manner in which said vest is attached to accommodate the growth of the fetus.

7. The garment according to claim 1, wherein said audio speaker pocket is strategically arranged so as to position, when said vest is worn, a pair of audio speakers in opposed relation to a fetus to provide the most efficient audio stimulation thereof.

8. A garment for providing an audio stimulation to a fetus comprising in combination:

a vest having a back, a left vest front bodice and a right vest front bodice, said left and right bodice defining in combination the front of the vest garment and connectable together at a generally vertical medial line, said left and right bodice each being permanently combined with the back, an audio speaker pocket provided on the vest positioned to fit over the stomach area of a user and adapted to support an audio speaker;

an audio signal source pocket provided on the vest and adapted to support a player, radio or the like as an audio signal source, and said audio speaker pocket and said audio signal source pocket being arranged to provide balanced counterweight of an audio speaker and an audio signal source when said vest is worn.

9. The garment according to claim 8, further including a transmission connection conduit from one of said bodices to the other of said bodices across the back.

10. The garment according to claim 8, further comprising means for positioning said audio speaker.

11. The garment according to claim 8, further comprising an audio speaker and a microphone system.

12. The garment according to claim 8, further comprising an audio signal source and an earphone system.

13. The garment according to claim 8, further comprising adjustable buttons wherein a pregnant woman can adjust the manner in which said vest is attached to accommodate the growth of the fetus.

* * * * *